US006576071B2

(12) United States Patent
Liu et al.

(10) Patent No.: US 6,576,071 B2
(45) **Date of Patent: *Jun. 10, 2003**

(54) HIGH TOUGHNESS PLATE ALLOY FOR AEROSPACE APPLICATIONS

(75) Inventors: John Liu, Murrysville, PA (US); Robert W. Westerlund, Davenport, IA (US); Gary H. Bray, Murrysville, PA (US); Terrence N. Thom, Bettendorf, IA (US); Dhruba J. Chakrabarti, Export, PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/072,365

(22) Filed: Feb. 7, 2002

(65) Prior Publication Data

US 2002/0079027 A1 Jun. 27, 2002

Related U.S. Application Data

(63) Continuation of application No. 09/208,963, filed on Dec. 10, 1998, now Pat. No. 6,444,058.

(60) Provisional application No. 60/069,591, filed on Dec. 12, 1997.

(51) Int. Cl.[7] ..... C22C 21/06

(52) U.S. Cl. ..... 148/439; 420/533

(58) Field of Search ..... 148/437, 439, 148/693, 696; 420/533, 534

(56) References Cited

U.S. PATENT DOCUMENTS

| | | | |
|---|---|---|---|
| 5,213,639 A | 5/1993 | Colvin et al. | 148/693 |
| 5,273,594 A | 12/1993 | Cassada, III | 148/696 |
| 5,863,359 A | 1/1999 | Karabin et al. | 148/437 |
| 5,865,914 A | 2/1999 | Karabin et al. | 148/693 |

*Primary Examiner*—Roy King
*Assistant Examiner*—Harry D. Wilkins, III
(74) *Attorney, Agent, or Firm*—Julie W. Meder; Matthew W. Smith

(57) ABSTRACT

The present invention is directed to highly controlled alloy composition relationship of a high purity Al—Mg—Cu alloy within the 2000 series aluminum alloys as defined by the Aluminum Association, wherein significant improvements are revealed in fracture toughness through plane strain, fracture toughness through plane stress, fatigue life, and fatigue crack growth resistance.

40 Claims, 5 Drawing Sheets

HIGH TOUGHNESS PLATE ALLOY FOR AEROSPACE APPLICATIONS

RELATED APPLICATION

This application is a continuation of U.S. patent application Ser. No. 09/208,963 filed Dec. 10, 1998, now U.S. Pat. No. 6,444,058, entitled "High Toughness Plate Alloy For Aerospace Applications" that claims the benefit of U.S. Provisional Application No. 60/069,591, filed Dec. 12, 1997.

FIELD OF THE INVENTION

This invention is directed to the use of 2000 series alloy plate to be used for wing and structural intermediaries for aerospace applications.

BACKGROUND OF THE INVENTION

The demands put on aluminum alloys have become more and more rigorous with each new series of airplane manufactured by the aerospace industry. The push is to provide aluminum alloys that are stronger and tougher than the generation of alloys before so that the aircraft industry may reduce the mass of the airplanes it builds to extend the flight range, and to realize savings in fuel, engine requirements, and other economies that can be achieved by a lighter airplane. The quest, no doubt, is to provide the aircraft industry with a high toughness and high strength aluminum alloy that is lighter than air.

U.S. Pat. No. 5,213,639 is directed to an invention which provides a 2000 series alloy which provides an aluminum product with improved levels of toughness and fatigue crack growth resistance at good strength levels. As is fully explained in that patent, which is herein incorporated by reference, there are often trade-offs in the treatment of an aluminum alloy in which it is difficult not to compromise one property in order to increase another by some alteration to the process for the manufacture of the alloy. For example, by changing the heat treatment or aging of the alloy to increase the strength, the toughness levels may decrease. The ultimate desire to those skilled in the aluminum alloy art is to be able to change one property without decreasing some other property and, thereby, making the alloy less desirable for its intended purpose.

Fracture sensitive properties in structural aerospace products, such as fracture toughness, fatigue initiation resistance, and resistance to the growth of fatigue cracks, are adversely affected by the presence of second phase constituents. This is related to the stresses which result from the load during service that are concentrated at these second phase constituents or particles. While certain aerospace alloys have incorporated the use of higher purity base metals to enhance the fracture sensitive properties, their property characteristics still fall short of the desired values, particularly fracture toughness, such as in the 2324-T39 lower wing skin plate alloy, which is considered a standard in the aerospace industry. This goes to demonstrate that the use of high purity base metal by itself is insufficient to provide the maximum fracture and fatigue resistance in the alloy.

The invention hereof provides an increase in properties selected from the group consisting of plane strain and plane stress fracture toughness, an increase in fatigue life, and an increase in fatigue crack growth resistance and combinations thereof. These are all desirable properties in an aerospace alloy. In the practice of this invention the alloy incorporates a balanced composition control strategy by the use of the maximum heat treating temperature while avoiding the incipient melting of the alloy. The use of high purity base metal and a systematic calculation from empirically derived equations is implemented to determine the optimum level of major alloying elements. Accordingly, the overall volume fraction of constituents derived from iron and silicon as well as from the major alloying elements copper and magnesium are kept below a certain threshold composition.

Increasing the above properties across the board allows the aerospace industry to design their planes differently since these properties will be consistently obtained under the practice of this invention. The present inventive alloys will be found useful for the manufacture of passenger and freight airplanes and will be particularly useful as structural components in aerospace products that bear tensile loads in service such as in the lower wing.

SUMMARY OF THE INVENTION

The present invention is directed to the 2000 series composition aluminum alloys as defined by the Aluminum Association wherein the composition comprises in weight percent about 3.60 to 4.25 copper, about 1.00 to 1.60 magnesium, about 0.30 to 0.80 manganese, no greater than 0.05 silicon, no greater than 0.07 iron, no greater than 0.06 titanium, no greater than 0.002 beryllium, the remainder aluminum and incidental elements and impurities. Preferably, the composition comprises in weight percent 3.85 to 4.05 copper, 1.25 to 1.45 magnesium, 0.55 to 0.65 manganese, no greater than 0.04 silicon, no greater than 0.05 iron, no greater than 0.04 titanium, no greater than 0.002 beryllium, the remainder aluminum and incidental elements and impurities. When citing a range of the alloy composition, the range includes all intermediate weight percents such as for magnesium, 1.00 would include 1.01 or 1.001 on up through and including 1.601 up to 1.649. This incremental disclosure includes each component of the present alloy.

In the practice of the invention, the heat treating temperature, $T_{max}$, should be controlled at as high a temperature as possible while still being safely below the lowest incipient melting temperature of the alloy, which is about 935° F. (502° C.). The observed improvements are selected from the group consisting of plane strain and plane stress fracture toughness, fatigue resistance, and fatigue crack growth resistance, and combinations thereof while essentially maintaining the strength, is accomplished by ensuring that the second phase particles derived from Fe and Si and those derived from Cu and/or Mg are substantially eliminated by composition control and during the heat treatment. The Fe bearing second phase particles are minimized by using high purity base metal with low Fe content. While it is desirable to have no Fe or Si at all, but for the commercial cost thereof, a low Fe and Si content according to the preferred composition range described hereinabove is acceptable for the purposes of the present invention.

The fracture toughness of an alloy is a measure of its resistance to rapid fracture with a preexisting crack or crack-like flaw present. The plane strain fracture toughness, KIc, is a measure of the fracture toughness of thick plate sections having a stress state which is predominantly plane strain. The apparent fracture toughness, $K_{app}$, is a measure of fracture toughness of thinner sections having a stress state which is predominately plane stress or a mixture of plane stress and plane strain. The inventive alloy can sustain a larger crack than the comparative alloy 2324-T39 in both thick and thin sections without failing by rapid fracture.

Alternatively, the inventive alloy can tolerate the same crack size at a higher operating stress than 2324-T39 without failure.

Typically, cold or other working may be employed which produces a working effect similar to (or substantially, i.e. approximately, equivalent to) that which would be imparted by stretching at room temperature in the range of about ½% or 1% or 1½% to 2% or up to 4 or 6% or 8% of the products' original length. Stretching or other cold working such as cold rolling about 2 or 3 to 9 or 10%, preferably about 4 or 5% to about 7 or 8%, can improve strength while retaining good toughness. Yield strength can be increased around 10 ksi, for instance to levels as high as around 59 or 60 ksi or more without excessively degrading toughness, even actually increasing toughness by 5 or 6 ksi√in ($K_c$ in L-T orientation), in one test by stretching 6 or 7%.

When referring to a minimum (for instance for strength or toughness) or to a maximum (for instance for fatigue crack growth rate), such refers to a level at which specifications for materials can be written or a level at which a material can be guaranteed or a level that an airframe builder (subject to safety factor) can rely on in design. In some cases, it can have a statistical basis wherein 99% of the product conforms or is expected to conform with 95% confidence using standard statistical methods.

Fracture toughness is an important property to airframe designers, particularly if good toughness can be combined with good strength. By way of comparison, the tensile strength, or ability to sustain load without fracturing, of a structural component under a tensile load can be defined as the load divided by the area of the smallest section of the component perpendicular to the tensile load (net section stress). For a simple, straight-sided structure, the strength of the section is readily related to the breaking or tensile strength of a smooth tensile coupon. This is how tension testing is done. However, for a structure containing a crack or crack-like defect, the strength of a structural component depends on the length of the crack, the geometry of the structural component, and a property of the material known as the fracture toughness. Fracture toughness can be thought of as the resistance of a material to the harmful or even catastrophic propagation of a crack under a tensile load.

Fracture toughness can be measured in several ways. One way is to load in tension a test coupon containing a crack. The load required to fracture the test coupon divided by its net section area (the cross-sectional area less the area containing the crack) is known as the residual strength with units of thousands of pounds force per unit area (ksi). When the strength of the material as well as the specimen are constant, the residual strength is a measure of the fracture toughness of the material. Because it is so dependent on strength and geometry, residual strength is usually used as a measure of fracture toughness when other methods are not as useful because of some constraint like size or shape of the available material.

When the geometry of a structural component is such that it doesn't deform plastically through the thickness when a tension load is applied (plane-strain deformation), fracture toughness is often measured as plane-strain fracture toughness, $K_{Ic}$. This normally applies to relatively thick products or sections, for instance 0.6 or 0.75 or 1 inch or more. The ASTM has established a standard test using a fatigue pre-cracked compact tension specimen to measure $K_{Ic}$ which has the units ksi√in. This test is usually used to measure fracture toughness when the material is thick because it is believed to be independent of specimen geometry as long as appropriate standards for width, crack length and thickness are met. The symbol K, as used in $K_{Ic}$, is referred to as the stress intensity factor. A narrower test specimen width is sometimes used for thick sections and a wider test specimen width for thinner products.

Structural components which deform by plane-strain are relatively thick as indicated above. Thinner structural components (less than 0.6 to 0.75 inch thick) usually deform under plane stress or more usually under a mixed mode condition. Measuring fracture toughness under this condition can introduce variables because the number which results from the test depends to some extent on the geometry of the test coupon. One test method is to apply a continuously increasing load to a rectangular test coupon containing a crack. A plot of stress intensity versus crack extension known as an R-curve (crack resistance curve) can be obtained this way. The load at a particular amount of crack extension based on a 25% secant offset in the load vs. crack extension curve and the crack length at that load are used to calculate a measure of fracture toughness known as $K_{R25}$. It also has the units of ksi√in. ASTM E561 (incorporated by reference) concerns R-curve determination.

When the geometry of the alloy product or structural component is such that it permits deformation plastically through its thickness when a tension load is applied, fracture toughness is often measured as plane-stress fracture toughness. The fracture toughness measure uses the maximum load generated on a relatively thin, wide pre-cracked specimen. When the crack length at the maximum load is used to calculate the stress-intensity factor at that load, the stress-intensity factor is referred to as plane-stress fracture toughness $K_c$. When the stress-intensity factor is calculated using the crack length before the load is applied, however, the result of the calculation is known as the apparent fracture toughness, $K_{app}$, of the material. Because the crack length in the calculation of $K_c$ is usually longer, values for $K_c$ are usually higher than $K_{app}$ for a given material. Both of these measures of fracture toughness are expressed in the units ksi√in. For tough materials, the numerical values generated by such tests generally increase as the width of the specimen increases or its thickness decreases.

It is to be appreciated that the width of the test panel used in a toughness test can have a substantial influence on the stress intensity measured in the test. A given material may exhibit a $K_{app}$ toughness of 60 ksi√in using a 6-inch wide test specimen, whereas for wider specimens the measured $K_{app}$ will increase with wider and wider specimens. For instance, the same material that had a 60 ksi√in $K_{app}$ toughness with a 6-inch panel could exhibit a higher $K_{app}$, for instance around 90 ksi√in, in a 16-inch panel and still higher $K_{app}$, for instance around 150 ksi√in, in a 48-inch wide panel test and still higher $K_{app}$, for instance around 180 ksi√in, with a 60-inch wide panel test specimen. Accordingly, in referring to K values for toughness herein, unless indicated otherwise, such refers to testing with a 16-inch wide panel. However, those skilled in the art recognize that test results can vary depending on the test panel width and it is intended to encompass all such tests in referring to toughness. Hence, toughness substantially equivalent to or substantially corresponding to a minimum value for $K_c$ or $K_{app}$ in characterizing the invention products, while largely referring to a test with a 16-inch panel, is intended to embrace variations in $K_c$ or $K_{app}$ encountered in using different width panels as those skilled in the art will appreciate. The testing typically is in accordance with ASTM E561 and ASTM B646 (both incorporated herein by reference).

Resistance to cracking by fatigue is a very desirable property. The fatigue cracking referred to occurs as a result of repeated loading and unloading cycles, or cycling between a high and a low load such as when a wing moves up and down or a fuselage swells with pressurization and contracts with depressurization. The loads during fatigue are below the static ultimate or tensile strength of the material measured in a tensile test and they are typically below the yield strength of the material. If a crack or crack-like defect exists in a structure, repeated cyclic or fatigue loading can cause the crack to grow. This is referred to as fatigue crack propagation. Propagation of a crack by fatigue may lead to a crack large enough to propagate catastrophically when the combination of crack size and loads are sufficient to exceed the material's fracture toughness. Thus, an increase in the resistance of a material to crack propagation by fatigue offers substantial benefits to aerostructure longevity. The slower a crack propagates, the better. A rapidly propagating crack in an airplane structural member can lead to catastrophic failure without adequate time for detection, whereas a slowly propagating crack allows time for detection and corrective action or repair.

The rate at which a crack in a material propagates during cyclic loading is influenced by the length of the crack. Another important factor is the difference between the maximum and the minimum loads between which the structure is cycled. One measurement including the effects of crack length and the difference between maximum and minimum loads is called the cyclic stress intensity factor range or ΔK, having units of ksi√in, similar to the stress intensity factor used to measure fracture toughness. The stress intensity factor range (ΔK) is the difference between the stress intensity factors at the maximum and minimum loads. Another measure affecting fatigue crack propagation is the ratio between the minimum and maximum loads during cycling, and this is called the stress ratio and is denoted by R, a ratio of 0.1 meaning that the maximum load is 10 times the minimum load.

The crack growth rate can be calculated for a given increment of crack extension by dividing the change in crack length (called Δa) by the number of loading cycles (ΔN) which resulted in that amount of crack growth. The crack propagation rate is represented by Δa/ΔN or 'da/dN' and has units of inches/cycle. The fatigue crack propagation rates of a material can be determined from a center cracked tension panel.

Still another technique in testing is use of a constant ΔK gradient. In this technique, the otherwise constant amplitude load is reduced toward the latter stages of the test to slow down the rate of ΔK increase. This adds a degree of precision by slowing down the time during which the crack grows to provide more measurement precision near the end of the test when the crack tends to grow faster. This technique allows the ΔK to increase at a more constant rate than achieved in ordinary constant load amplitude testing.

One way in which the improvements observed in the inventive alloy can be utilized by aircraft manufacturers is to reduce operating costs and aircraft downtime by increasing inspection intervals. The number of flight cycles to the initial or threshold inspection for a component depends primarily on the fatigue initiation resistance of an alloy and the fatigue crack propagation resistance at low ΔK, stress intensity factor range. The inventive alloy exhibits improvements relative to 2324-T39 in both properties which may allow the threshold inspection interval to be increased. The number of flight cycles at which the inspection must be repeated, or the repeat inspection interval, primarily depends on fatigue crack propagation resistance of an alloy at medium to high ΔK and the critical crack length which is determined by its fracture toughness. Once again, the inventive alloy exhibits improvements relative to 2324-T39 in both properties allowing for repeat inspection intervals to be increased.

An additional way in which the aircraft manufacturers can utilize the improvements in the inventive alloy is to increase operating stress and reduce aircraft weight while maintaining the same inspection interval. The reduced weight may result in greater fuel efficiency, greater cargo and passenger capacity and/or greater aircraft range.

DETAILED DESCRIPTION

Figure 5:
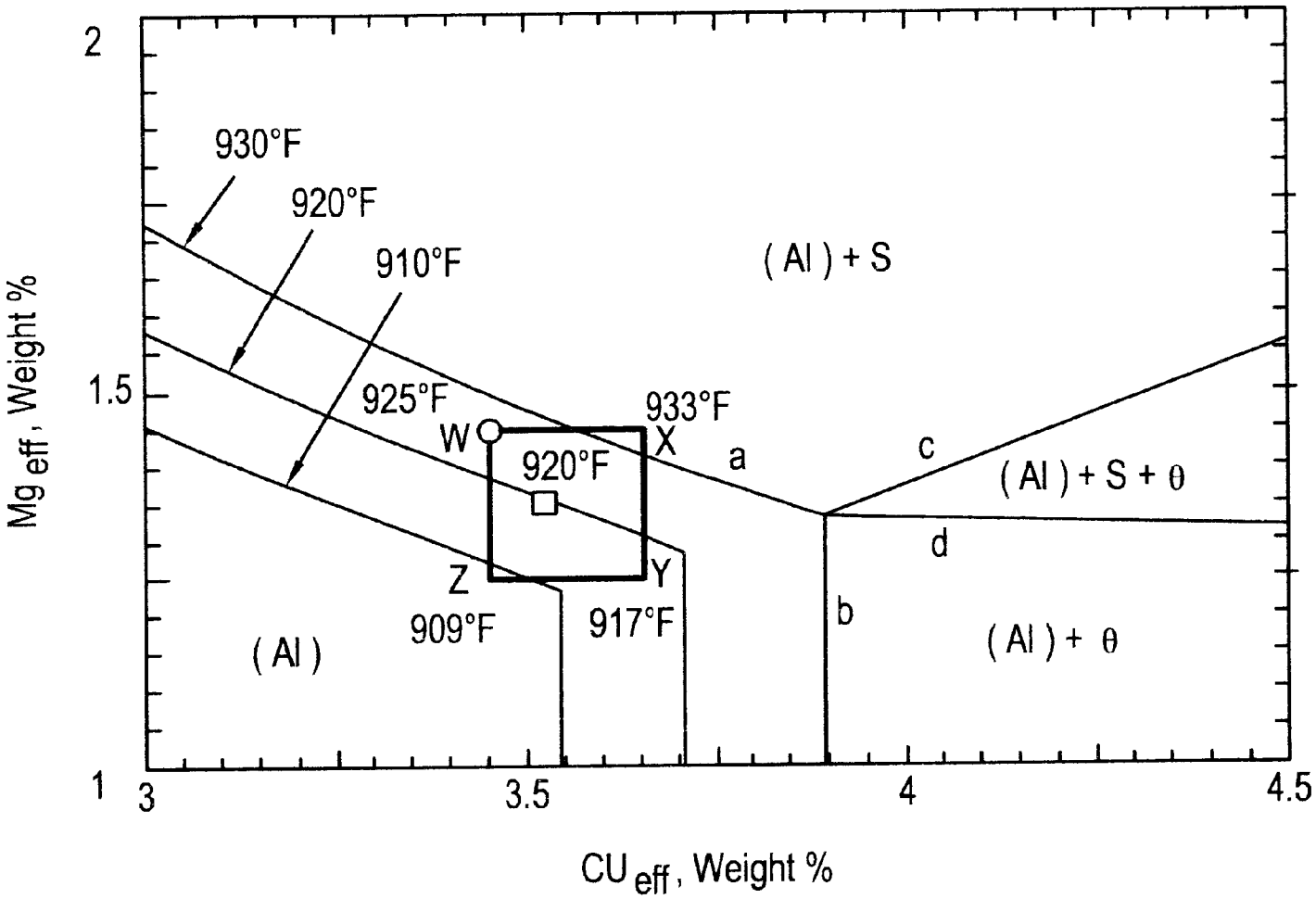
FIG. 5 is a phase diagram showing isothermal section plots of the Al—Cu—Mg system for the temperatures 910°, 920°, and 930° F.

FIG. 5 shows calculated isothermal section plots of the Al—Cu—Mg system for the temperatures 910° F. (488° C.), 920° F. (493° C.), and 930° F. (498° C.). Of these, only the 930° F. plot displays all the phase boundaries. The other phase boundaries have been omitted from the other isothermal lines for clarity and to better understand how the compositions of the 2000 series aluminum alloys were derived. The isothermal section shows the different phase fields that coexist at different temperatures and compositions of interest in this alloy system.

For example, for the 930° F. isothermal section, the composition regions of Mg and Cu are divided into four phase fields. These are the single phase aluminum matrix field (Al) bounded by the lines a and b to the left; the two-phase field consisting of Al and S ($Al_2CuMg$) bounded by the lines a and c; the two-phase field consisting of Al and θ ($Al_2Cu$) bounded by the lines b and d; and the three-phase field consisting of Al, S and θ bounded by the lines c and d.

These diagrams help to define a composition box or limitations of Cu and Mg and the ideal solution heat treatment (SHT) temperatures for an alloy composition that is positioned inside the single phase field of the Al matrix. FIG. 5 also shows that the Al single phase field shrinks progressively with respect to the Cu and Mg compositions as the temperature is lowered, as compared to 920° and 910° F. phase boundaries. This indicates that the solubility of the elements may be increased by treating the alloy at higher temperatures.

As recited above, it is important to confine the inventive compositions within the defined limitations of the isothermal plots so as to be inside the aluminum matrix single phase field. The compositions as shown in these plots are defined as effective compositions. The target compositions that make up the actual alloy can differ from the effective compositions since, at higher temperatures, a portion of the elemental composition of Cu is available to react with Fe and Mn and a portion of the elemental composition of Mg is available to react with Si, which are then not available for the intended alloying purposes. These amounts are to be made up by requisite extra additions to the effective composition levels required by the equilibrium diagram considerations as in the isothermal plots of FIG. 5. For example, in reference to FIG. 5, the highest Cu for 1.45 Mg weight percent that remains within the single phase field at $T_{max}$ of 925° F. is a weight percent of 3.42 for Cu. This is defined as the effective Cu, or $Cu_{eff}$, which will be the Cu available to alloy with Mg for strengthening. To account for the part of Cu that will be lost through reaction with Fe and Mn, the total Cu or $Cu_{target}$, required is calculated from the following expression:

$$Cu_{target}=Cu_{eff}+0.74(Mn-0.2)+2.28(Fe-0.005)$$

$$Cu_{target}=3.42+0.40=3.82$$

Note: This is for an Fe level of 0.05 and Mn=0.60

It is observed that a $Cu_{target}$=3.85 weight percent is obtained at a $T_{max}$=925° F. Accordingly, the overall composition target for this example at a 925° F. heat treatment is in weight percent: 0.02 Si, 0.05 Fe, 3.85 Cu, 1.45 Mg, 0.60 Mn, the remainder Al and incidental elements and impurities. This defines the "W" corner of the composition box in FIG. 5.

As a second example, choosing a different $Mg_{target}$ of 1.35 weight percent and a $T_{max}$ equal to 920° F., the corresponding composition target is, in weight percent: 0.02 Si, 0.05 Fe, 3.92 Cu, 1.35 Mg, 0.60 Mn, the remainder Al and incidental elements and impurities. This defines the composition near the center of the composition box as a preferred target composition.

Just as a $Mg_{target}$ weight percent can be chosen to find the appropriate $Cu_{target}$, it is possible to work such a determination in reverse, by choosing a $Cu_{target}$ to determine the amount of maximum Mg provided to the alloy composition. In this manner, a composition box for the preferred Cu and Mg combinations can be prepared for the cases with the maximum constant weight percents of 0.05 of Fe, 0.02 of Si and 0.6 of Mn. This has been superimposed on the Figure as the square box, defined by points W, X, Y, and Z. This composition box has a range of SHT temperatures between about 910° to 930° F.

Alloys within the W, X, Y, and Z box for a given SHT temperature can be selected so that little or no second phase particles should be present in the final alloy product.

To a certain extent, the above recited box can breathe. What is meant by this is that a small amount of boundary expansion can be effected by a decrease in the amount of silicon present, such as at less than 0.02, 0.03, or 0.04 weight percent. It is believed, although the inventors hereof do not want to be held to this belief, that by decreasing silicon to such minute levels, magnesium silicide as a reaction product is made in a de minimus amount or simply this reaction product is substantially inhibited. When this occurs, the incipient melting temperature increases above the lowest normal incipient melting temperature. That temperature increase allows a corresponding increase in solute concentration that will positively increase the important properties herein discussed. As a result of this decrease in the magnesium silicide reaction product, an increase in the maximum temperature attainable can be realized. The maximum temperature may be increased by about 1, 2, 3, 4, or 5° F. When this occurs, the box W, X, Y, Z expands beyond its boundaries by the above 1° to 5° F. temperature range.

By defining the composition limits by this iterative method, it was possible, upon appropriate processing, to achieve the desired strength goals. What is surprising, however, is that significant improvements in both fracture toughness and fatigue properties were also obtained without any strength compromise which have not been heretofore observed for this alloy group. Generally, when adjusting the composition of aluminum alloys as those skilled in this art appreciate, when one property gains, the usual circumstance is that another property suffers. Such is not the case under the present invention.

Figure 1:
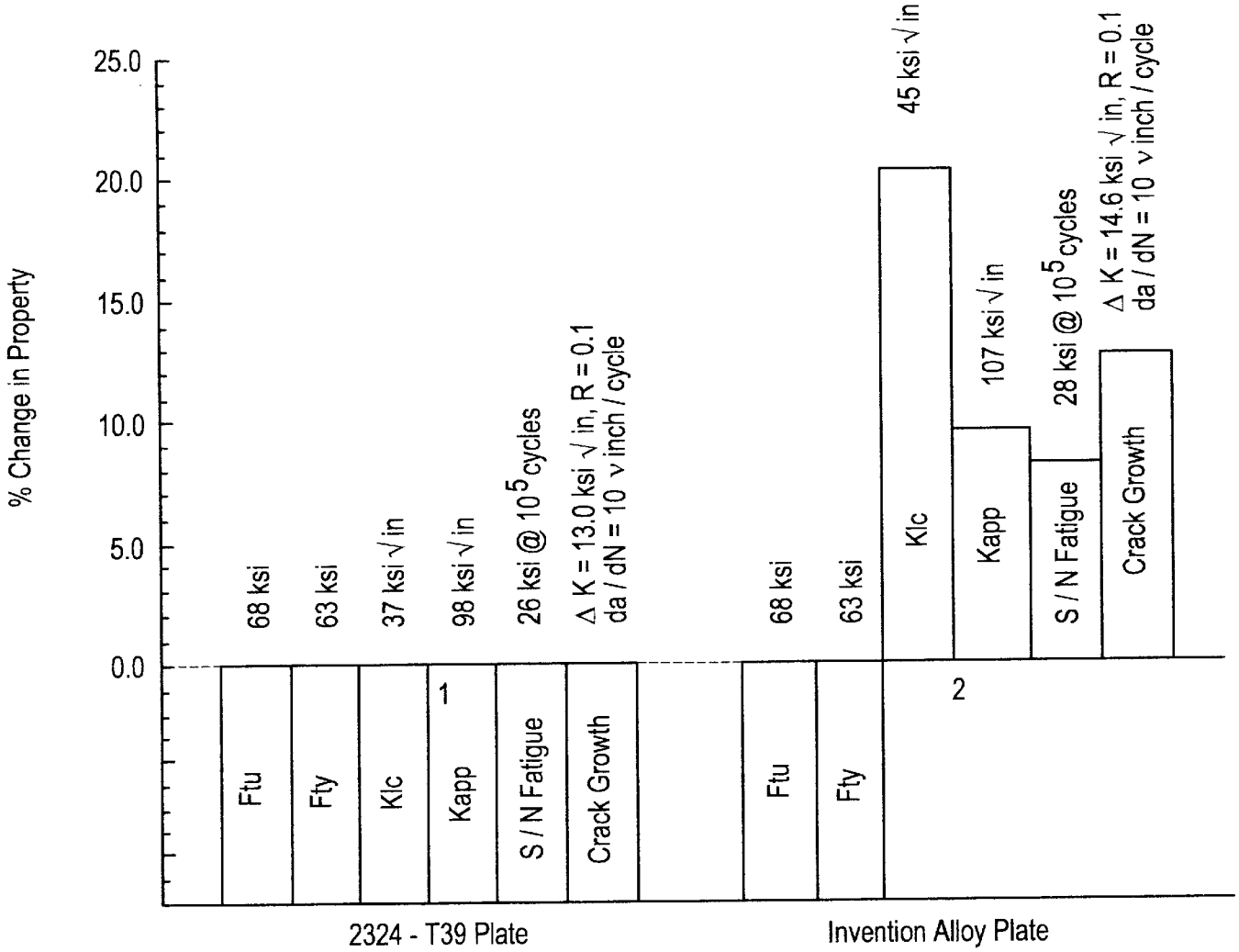
FIG. 1 shows a comparison of 2324-T39 plate with the properties of the inventive alloy.

FIG. 1 provides a summary comparison of the properties of 2324-T39 to that of the present invention. It is noteworthy that KIc, a measure of the plane strain fracture toughness, improved by 21.6 percent, $K_{app}$, a measure of the plane stress fracture toughness, improved by 9.2 percent, S/N fatigue resistance improved by 7.7 percent and the fatigue crack growth rate decreased by 12.3 percent, a decrease in this last property defined as an improvement, all over the analogous properties of 2324-T39 alloy. None of the other properties were decreased in the inventive alloy yet significant increases are noted in four primary properties. In any event, in the invention hereof, the minimum improvement observed in each of the properties is over 5% or over 5.5% preferably over 6% or 6.5% and most preferably over 7% or even 7.5%, of 2324-T39 as a standard prior art alloy, while maintaining an essentially constant high level yield strength at the same temper.

Figure 4:
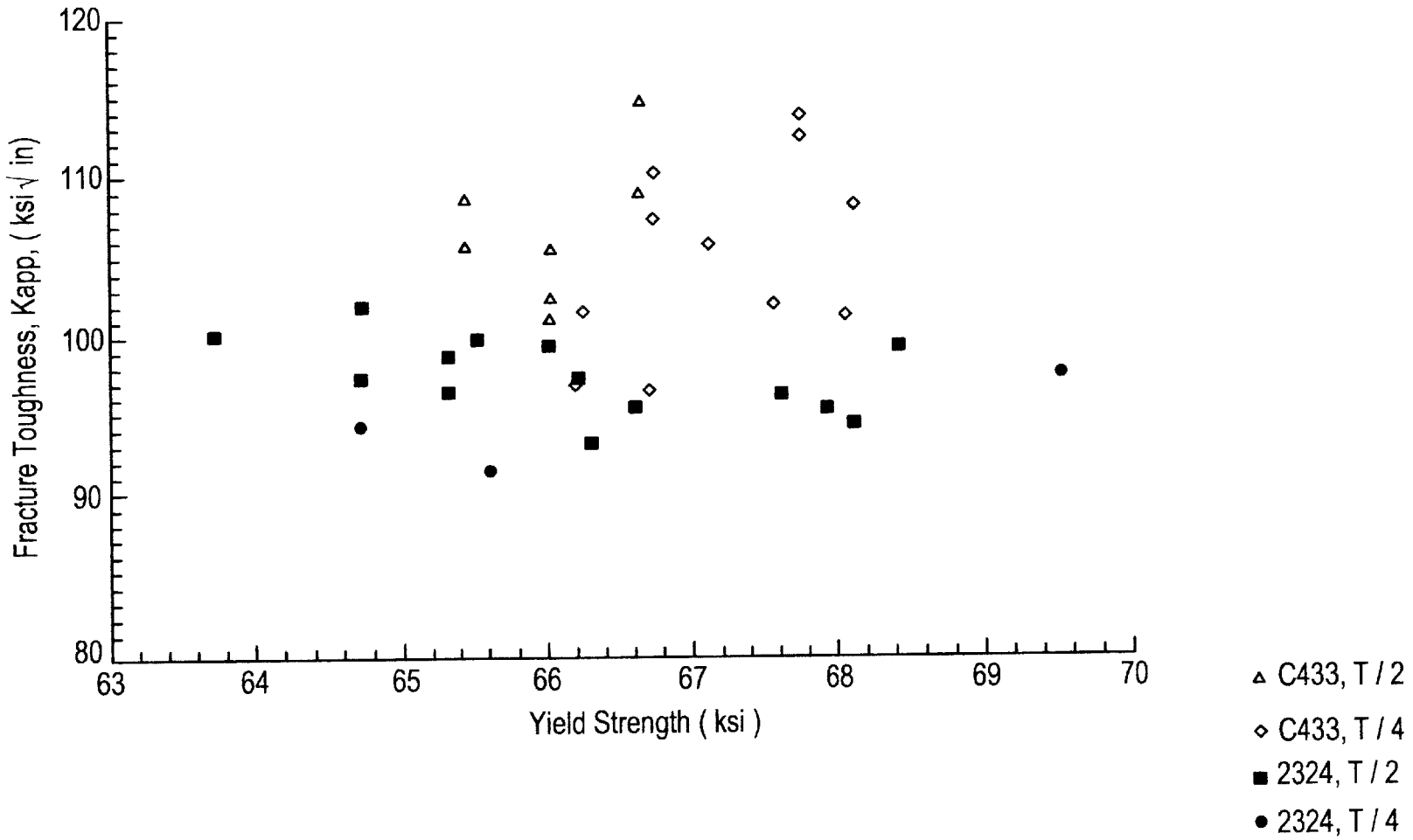
FIG. 4 shows a plot of yield strength versus $K_{app}$ fracture toughness.

FIG. 4 is a plot of $K_{app}$ fracture toughness versus yield strength. This is a measure of the fracture toughness for thin sections of alloy. The inventive alloy shows a marked increase fracture toughness over the comparison alloy without a negative effect on the yield strength. It is noticed that the sample batch of the inventive alloy appears to have established a higher band of properties for $K_{app}$ fracture toughness for this family of alloys.

Figure 2:
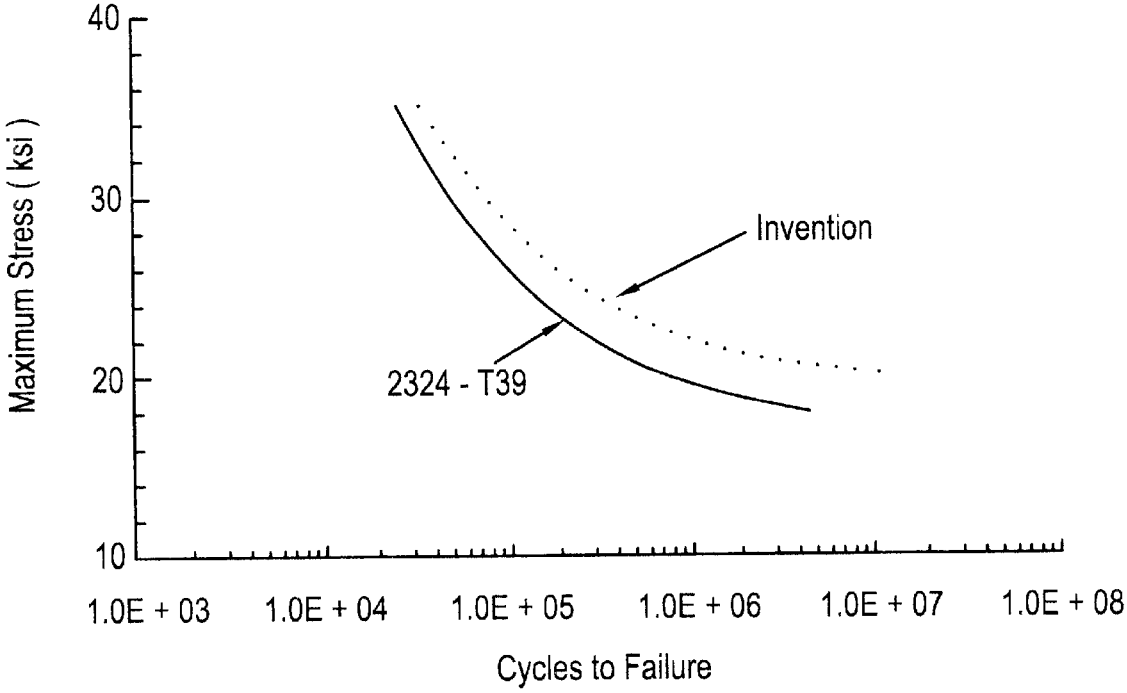
FIG. 2 shows the S/N fatigue resistance improvement of the inventive alloy as compared with the 2324-T39 alloy as maximum stress is plotted versus cycles to failure.

The S/N fatigue curves of the inventive alloy and 2324-T39 are shown in FIG. 2. The S/N fatigue curve of an alloy is a measure of its resistance to the initiation or the formation of a fatigue crack versus the applied stress level. The S/N fatigue curves for the inventive alloy and the 2324-T39 indicate that at a given stress level, more applied load cycles are required to initiate a crack in the inventive alloy than in 2324-T39. Alternatively, the inventive alloy can be subjected to a higher operating stress while providing the same fatigue initiation resistance as 2324-T39.

Figure 3:
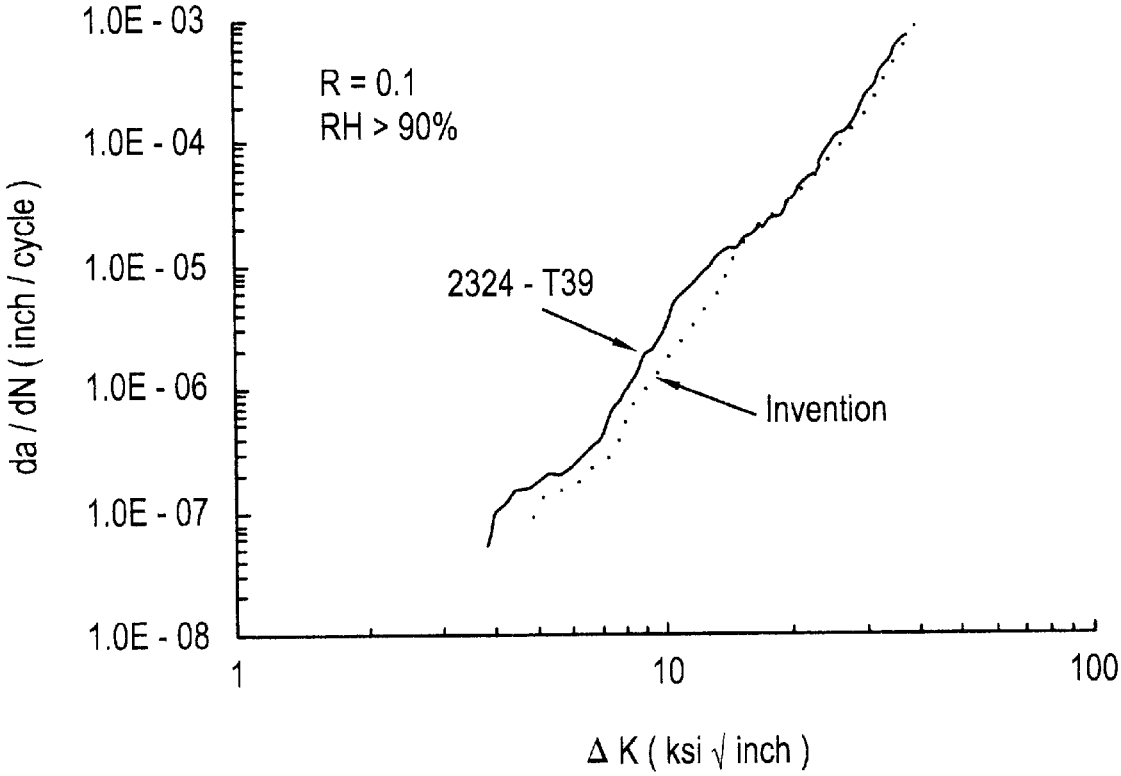
FIG. 3 shows the increase in fatigue crack growth resistance of the inventive alloy as illustrated by the plot of da/dN versus ΔK.

The fatigue crack growth curves of the inventive alloy and 2324-T39 are shown in FIG. 3. The fatigue crack growth curve of an alloy is a measure of its resistance to propagation of an existing fatigue crack in terms of crack growth rate or da/dN versus the applied load expressed in terms of the linear elastic stress intensity factor range or $\Delta K$. A lower crack growth rate at a given applied $\Delta K$ indicates greater resistance to fatigue crack propagation. The inventive alloy exhibits lower fatigue crack growth rates than 2324-T39 at a given applied $\Delta K$ in the lower and middle portions of the fatigue crack growth curve. This means that the number of applied load cycles needed to propagate a crack from a small initial crack or crack-like flaw to a critical crack length is greater in the inventive alloy than in 2324-T39. Alternatively, the inventive alloy can be subjected to a higher operating stress while providing the same resistance to fatigue crack propagation as 2324-T39.

One way in which the improvements observed in the inventive alloy can be utilized by aircraft manufacturers is to reduce operating costs and aircraft downtime by increasing inspection intervals. The number of flight cycles to the initial or threshold inspection for a component depends primarily on the fatigue initiation resistance of an alloy and the fatigue crack propagation resistance at low ΔK. The inventive alloy exhibits improvements relative to 2324-T39 in both properties which may allow the threshold inspection interval to be increased. For example, at low stress intensity factor range of ΔK=5 ksi√in, da/dN for 2324 is $1.76\times10^{-7}$ in./cycle, while that for the inventive alloy is $1.26\times10^{-7}$ in./cycle, representing a decrease in the crack growth rate of 28%. The number of flight cycles at which the inspection must be repeated, or the repeat inspection interval, primarily depends on fatigue crack propagation resistance of an alloy at medium to high ΔK and the critical crack length which is determined by its fracture toughness. Once again, the inventive alloy exhibits improvements relative to 2324-T39 in both properties possibly allowing for repeat inspection intervals to be increased. For example, at medium stress intensity factor range of ΔK=14.3 ksi√in, the crack growth rate da/dN for 2324 is $1.39\times10^{-5}$ in./cycle, and that for the inventive alloy is $9.37\times10^{-6}$ in./cycle, representing a decrease in the crack growth rate of 33%.

We claim:

1. A 2000 series aluminum product alloy consisting essentially of in weight percent about 3.60 to 4.25 copper, about 1.00 to 1.60 magnesium, about 0.30 to 0.80 manganese, no greater than about 0.05 silicon, no greater than about 0.07 iron, no greater than about 0.06 titanium, no greater than about 0.002 beryllium, the remainder aluminum and incidental elements and impurities, wherein a $T_{max}$ heat treatment is below the lowest incipient melting temperature for a given 2000 series alloy composition and the $Cu_{target}$ is determined by the expression:

$$Cu_{target}=Cu_{eff}+0.74(Mn-0.2)+2.28(Fe-0.005)$$

wherein said alloy improves by a minimum of 5% compared to the average values of standard 2324-T39 alloy shown in FIG. 1 for the same properties selected from the group consisting of the plane strain fracture toughness, $K_{Ic}$, the plane stress fracture toughness, $K_{app}$, the stress intensity factor range, ΔK, at a fatigue crack growth rate of 10μ-inch/cycle wherein R=0.1 and RH is greater than 90%, and combinations thereof.

2. A 2000 series aluminum product alloy consisting essentially of a composition within the box of W, X, Y, and Z as defined in FIG. 5, wherein $T_{max}$ for each composition corner point is W=925° F., X=933° F., Y=917° F., and Z=909° F., wherein $Cu_{target}$ is defined by the following equation:

$$Cu_{target}=Cu_{eff}+0.74(Mn-0.2)+2.28(Fe-0.005).$$

3. The 2000 series aluminum alloy of claim 1 wherein the $Cu_{target}$ composition is about 3.85 to about 4.05 weight percent and the $Mg_{target}$ is about 1.25 to about 1.45 weight percent.

4. The 2000 series aluminum alloy of claim 1 wherein said minimum improves by 5.5%.

5. The 2000 series aluminum alloy of claim 1 wherein said minimum improves by 6%.

6. The 2000 series aluminum alloy of claim 1 wherein said minimum improves by 6.5%.

7. The 2000 series aluminum alloy of claim 1 wherein said minimum improves by 7%.

8. The 2000 series aluminum alloy of claim 1 wherein said minimum improves by 7.5%.

9. The 2000 series aluminum alloy of claim 1 wherein said alloy is a structural component in an aerospace product.

10. The 2000 series aluminum alloy of claim 1 wherein said alloy is a part of a lower wing.

11. The 2000 series aluminum alloy of claim 2 wherein said alloy improves by a minimum of 5% compared to the average values of standard 2324-T39 alloy shown in FIG. 1 for the same properties selected from the group consisting of the plane strain fracture toughness, $K_{Ic}$, the plane stress fracture toughness, $K_{app}$, the stress intensity factor range, ΔK, at a fatigue crack growth rate of 10μ-inch/cycle wherein R=0.1 and RH is greater than 90%, and combinations thereof.

12. The 2000 series aluminum alloy of claim 2 wherein said alloy improves by a minimum of 5.5% compared to the average values of standard 2324-T39 alloy shown in FIG. 1 for the same properties selected from the group consisting of the plane strain fracture toughness, $K_{Ic}$, the plane stress fracture toughness, $K_{app}$, the stress intensity factor range, ΔK, at a fatigue crack growth rate of 10μ-inch/cycle wherein R=0.1 and RH is greater than 90%, and combinations thereof.

13. The 2000 series aluminum alloy of claim 2 wherein said alloy improves by a minimum of 6% compared to the average values of standard 2324-T39 alloy shown in FIG. 1 for the same properties selected from the group consisting of the plane strain fracture toughness, $K_{Ic}$, the plane stress fracture toughness, $K_{app}$, the stress intensity factor range, ΔK, at a fatigue crack growth rate of 10μ-inch/cycle wherein R=0.1 and RH is greater than 90%, and combinations thereof.

14. The 2000 series aluminum alloy of claim 2 wherein said alloy improves by a minimum of 6.5% compared to the average values of standard 2324-T39 alloy shown in FIG. 1 for the same properties selected from the group consisting of the plane strain fracture toughness, $K_{Ic}$, the plane stress fracture toughness, $K_{app}$, the stress intensity factor range, ΔK, at a fatigue crack growth rate of 10μ-inch/cycle wherein R=0.1 and RH is greater than 90%, and combinations thereof.

15. The 2000 series aluminum alloy of claim 2 wherein said alloy improves by a minimum of 7% compared to the average values of standard 2324-T39 alloy shown in FIG. 1 for the same properties selected from the group consisting of the plane strain fracture toughness, $K_{Ic}$, the plane stress fracture toughness, $K_{app}$, the stress intensity factor range, ΔK, at a fatigue crack growth rate of 10μ-inch/cycle wherein R=0.1 and RH is greater than 90%, and combinations thereof.

16. The 2000 series aluminum alloy of claim 2 wherein said alloy improves by a minimum of 7.5% compared to the average values of standard 2324-T39 alloy shown in FIG. 1 for the same properties selected from the group consisting of the plane strain fracture toughness, $K_{Ic}$, the plane stress fracture toughness, $K_{app}$, the stress intensity factor range, ΔK, at a fatigue crack growth rate of 10μ-inch/cycle wherein R=0.1 and RH is greater than 90%, and combinations thereof.

17. The 2000 series aluminum alloy of claim 2 wherein said alloy is a structural component in an aerospace product.

18. The 2000 series aluminum alloy of claim 1 wherein said alloy is a part of a lower wing.

19. The 2000 series aluminum alloy of claim 2 wherein said $T_{max}$ increases from about 1, 2, 3, 4, or 5° F. when silicon is less than about 0.04 weight percent.

20. The 2000 series aluminum alloy of claim 2 wherein said $T_{max}$ increases from about 1, 2, 3, 4, or 5° F. when silicon is less than about 0.03 weight percent.

21. The 2000 series aluminum alloy of claim 1 wherein said alloy is in a T-39 temper.

22. The 2000 series aluminum alloy of claim 1 wherein said alloy is in a T-351 temper.

23. The 2000 series aluminum alloy of claim 1 wherein said $K_{Ic}$ improves by a minimum of 1.9 in.

24. The 2000 series aluminum alloy of claim 1 wherein said $K_{app}$ improves by a minimum of 4.9 ksi√in.

25. The 2000 series aluminum alloy of claim 1 wherein said ΔK at a fatigue crack growth rate of 10μ-inch/cycle improves by a minimum of 0.65 ksi√in with R equal to 0.1 and RH greater than 90%.

26. The 2000 series aluminum alloy of claim 1 wherein said $K_{Ic}$ improves by a minimum of 2.0 ksi√in.

27. The 2000 series aluminum alloy of claim 1 wherein said $K_{app}$ improves by a minimum of 5.4 ksi√in.

28. The 2000 series aluminum alloy of claim 1 where in said ΔK at a fatigue crack growth rate of 10μ-inch/cycle improves by a minimum of 0.71 ksi√in with R equal to 0.1 and RH greater than 90%.

29. The 2000 series aluminum alloy of claim 1 wherein said $K_{Ic}$ improves by a minimum of 2.2 ksi√in.

30. The 2000 series aluminum alloy of claim 1 wherein said $K_{app}$ improves by a minimum of 5.9 ksi√in.

31. The 2000 series aluminum alloy of claim 1 wherein said ΔK at a fatigue crack growth rate of 10μ-inch/cycle improves by a minimum of 0.80 ksi√in n with R equal to 0.1 and RH greater than 90%.

32. The 2000 series aluminum alloy of claim 1 wherein said $K_{Ic}$ improves by a minimum of 2.4 ksi√in.

33. The 2000 series aluminum alloy of claim 1 wherein said $K_{app}$ improves by a minimum of 6.4 ksi√in.

34. The 2000 series aluminum alloy of claim 1 wherein said ΔK at a fatigue crack growth rate of 10μ-inch/cycle improves by a minimum of 0.85 ksi√in with R equal to 0.1 and RH greater than 90%.

35. The 2000 series aluminum alloy of claim 1 wherein said $K_{Ic}$ improves by a minimum of 2.6 ksi√in.

36. The 2000 series aluminum alloy of claim 1 wherein said $K_{app}$ improves by a minimum of 6.9 ksi√in.

37. The 2000 series aluminum alloy of claim 1 where in said ΔK at a fatigue crack growth rate of 10μ-inch/cycle improves by a minimum of 0.90 ksi√in with R equal to 0.1 and RH greater than 90%.

38. The 2000 series aluminum alloy of claim 1 wherein said $K_{Ic}$ improves by a minimum of 2.8 ksi√in.

39. The 2000 series aluminum alloy of claim 1 wherein said $K_{app}$ improves by a minimum of 7.4 ksi√in.

40. The 2000 series aluminum alloy of claim 1 wherein said ΔK at a fatigue crack growth rate of 10μ-inch/cycle improves by a minimum 1.00 ksi√in with R equal to 0.1 and RH greater than 90%.

* * * * *

US006576071C1

(12) EX PARTE REEXAMINATION CERTIFICATE (5804th)

United States Patent

Liu et al.

(10) Number: US 6,576,071 C1

(45) Certificate Issued: *Jul. 3, 2007

(54) HIGH TOUGHNESS PLATE ALLOY FOR AEROSPACE APPLICATIONS

(75) Inventors: John Liu, Murrysville, PA (US); Robert W. Westerlund, Davenport, IA (US); Gary H. Bray, Murrysville, PA (US); Terrence N. Thom, Bettendorf, IA (US); Dhruba J. Chakrabarti, Export, PA (US)

(73) Assignee: Alcoa Inc., Pittsburgh, PA (US)

Reexamination Request:
No. 90/007,342, Dec. 9, 2004

Reexamination Certificate for:

| | |
|---|---|
| Patent No.: | **6,576,071** |
| Issued: | **Jun. 10, 2003** |
| Appl. No.: | **10/072,365** |
| Filed: | **Feb. 7, 2002** |

( * ) Notice: This patent is subject to a terminal disclaimer.

Related U.S. Application Data

(63) Continuation of application No. 09/208,963, filed on Dec. 10, 1998, now Pat. No. 6,444,058.

(60) Provisional application No. 60/069,591, filed on Dec. 12, 1997.

(51) Int. Cl.

| | |
|---|---|
| *C22C 21/16* | (2006.01) |
| *C22C 21/12* | (2006.01) |
| *C22F 1/057* | (2006.01) |

(52) U.S. Cl. ..... 148/439; 420/533

(58) Field of Classification Search ..... None
See application file for complete search history.

(56) References Cited

U.S. PATENT DOCUMENTS 4,294,625 A * 10/1981 Hyatt et al. ..... 148/550
5,863,359 A * 1/1999 Karabin et al. ..... 148/437
5,938,867 A * 8/1999 Dorward et al. ..... 148/693

OTHER PUBLICATIONS

J.E. Vruggink "Use of the Microprobe in Fracture Analysis", Alcoa Center, PA. 1973.*
"The Boeing 777" article, 2003.*
Journal of Metals, "Improved Aluminum Alloys for Airframe Application" abstract, 1979.*
"Advanced Aluminum Alloy Plate Materials for Damage Tolerant Aircraft Structures"0 article, 1985, pp. 259–264.*
International Alloy Designations and Chemical Composition Limits for Wrought Aluminum and Wrought Aluminum Alloys, 2004.*
Tempers fo Aluminum and Aluminum Alloy Products, 1995.*
"Aluminum Alloys Worth Waiting For", article, 1980.*
Technical Report 91071 Mechanical Properties of 2024–T3 Aluminum Alloy Sheet, 1991.*
Damage Tolerant Design Handbook—A Complation of Fracture and Crack Growth Data for High Strength Alloys, 1999.*
Advanced Materials Processes, "High–Strength Aluminum Alloys Helps Boeing 777 Fly Farther", 2003.*
Airbus News—"Singapore Airlines A340–500 Flies into the Record Books", article, 2004.*
New Aluminum Alloys Products for the Airbus A380, 2004.*
Staley, J.T., Investigation to Improve the Stress Corrosion Resistance of Aluminum Aircraft Alloys through Alloy Additions and Specialized Heat Treatment, NTIS, Feb. 28, 1969.*
Registration Record of International Alloy Designations and Chemical Composition Limits for Wrought Aluminum and Wrought Aluminum Alloys, The Aluminum Association, Washington, DC, Revised Jun. 1994.*

* cited by examiner

*Primary Examiner*—Kiley Stoner

(57) ABSTRACT

The present invention is directed to highly controlled alloy composition relationship of a high purity Al—Mg—Cu alloy within the 2000 series aluminum alloys as defined by the Aluminum Asociation, wherein significant improvements are revealed in fracture toughness through plane strain, fracture toughness through plane stress, fatigue life, and fatigue crack growth resistance.

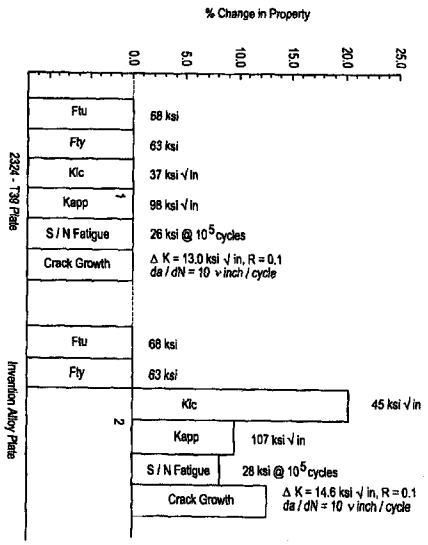

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 11 is cancelled.

Claims 1, 2, 3 and 19–20 are determined to be patentable as amended.

Claims 4–10, 12–18 and 21–40, dependent on an amended claim, are determined to be patentable.

1. A 2000 series aluminum *alloy* product [alloy] consisting essentially of a composition in weight percent *of* about 3.60 to 4.25 copper, about 1.00 to 1.60 magnesium, about 0.30 to 0.80 manganese, no greater than about 0.05 silicon, no greater than about 0.07 iron, no greater than about 0.06 titanium, no greater than about 0.002 beryllium, the remainder aluminum and incidental elements and impurities, wherein [a $T_{max}$ heat treatment is below the lowest incipient melting temperature] *the alloy product has been heat treated at a temperature that is higher than that* for a given 2000 series alloy composition *containing* $Mg_2Si$ and[the $Cu_{target}$ is determined by the expression:

$$Cu_{target}=Cu_{eff}+0.74(Mn-0.2)+2.28(Fe-0.005)$$

wherein]. said alloy [improves] *product has damage tolerant properties improved* by a minimum of 5% compared to the average values of standard 2324-T39 alloy shown in FIG. 1 for the same properties selected from the group consisting of the plane strain fracture toughness, $K_{Ic}$, the plane stress fracture toughness, $K_{app}$, the stress intensity factor range, ΔK, at a fatigue crack growth rate of 10μ-inch/cycle wherein R=0.1 and RH is greater than 90%, and combinations thereof.

2. A 2000 series aluminum *alloy* product [alloy] consisting essentially of a composition *in weight percent having an effective composition of elements* within the box of W[, X, Y, and Z] ($Cu_{eff}$*=3.45, Mg=1.45*), *X* ($Cu_{eff}$*=3.65, Mg=1.45*), *Y* ($Cu_{eff}$*=3.65, Mg=1.25*), *Z* ($Cu_{eff}$*=3.45, Mg=1.25*) as defined in FIG. 5, [wherein $T_{max}$ for each composition corner point is W=925° F., X=933° F., Y=917° F., and Z=909° F.,] *about 0.30 to 0.80 manganese, no greater than about 0.07 iron, no greater than about 0.05 silicon;* wherein [$Cu_{target}$] *the effective Cu* is defined by the following equation:

$$[Cu_{target}=Cu_{eff}+0.74(Mn-0.2)+2.28(Fe-0.005)]$$

$$Cu_{eff}=Cu_{target}-0.74(Mn-0.2)-2.28(Fe-0.005);\ and$$

*said alloy product has damage tolerant properties improved by a minimum of 5% compared to the average values of standard 2324-T39 alloy shown in FIG. 1 for the same properties selected from the group consisting of the plane strain fracture toughness,* $K_{Ic}$, *the plane stress fracture toughness,* $K_{app}$, *the stress intensity factor range, ΔK, at a fatigue crack growth rate of 10μ-inch/cycle wherein R=0.1 and RH is greater than 90% and combinations thereof.*

3. The 2000 series aluminum alloy of claim 1 wherein the [$Cu_{target}$] *copper* composition is about 3.85 to about 4.05 weight percent and the [$Mg_{target}$] *magnesium* is about 1.25 to about 1.45 weight percent.

19. The 2000 series aluminum alloy of claim [2] *1* wherein said [$T_{max}$] *heat treatment temperature* increases from about 1, 2, 3, 4, or 5° F. when silicon is less than about 0.04 weight percent.

20. The 2000 series aluminum alloy of claim [2] *1* wherein said [$T_{max}$] *heat treatment temperature* increases from about 1, 2, 3, 4, or 5° F. when silicon is less than about 0.03 weight percent.

* * * * *